United States Patent [19]

Beck

[11] Patent Number: 4,490,652

[45] Date of Patent: Dec. 25, 1984

[54] FLAT CATHODE RAY TUBE WITH KEYSTONE COMPENSATION

[75] Inventor: Vernon D. Beck, Ridgefield, Conn.

[73] Assignee: International Business Machines Corporation, Armonk, N.Y.

[21] Appl. No.: 454,765

[22] Filed: Dec. 30, 1982

[51] Int. Cl.[3] ..... H01J 29/70; H01J 29/72

[52] U.S. Cl. ..... 315/366; 315/370; 313/422

[58] Field of Search ..... 315/366, 370, 371; 313/422

[56] References Cited

U.S. PATENT DOCUMENTS

| | | | |
|---|---|---|---|
| 2,455,977 | 12/1948 | Bocciarelli | 315/370 |
| 2,957,097 | 10/1960 | Schagen et al. | 315/366 |
| 2,989,584 | 6/1961 | Mengle | 315/370 |
| 3,299,314 | 1/1967 | Yamada et al. | 315/366 |
| 3,793,554 | 2/1974 | Rossaert | 315/370 |
| 3,890,541 | 6/1975 | McCarthy et al. | 315/366 |

*Primary Examiner*—Theodore M. Blum

*Attorney, Agent, or Firm*—Pollock, Vande Sande & Priddy

[57] ABSTRACT

Apparatus for compensating for keystone distortion in a flat cathode ray tube in a relatively straightforward and inexpensive manner, and for providing a tube having relatively high resolution and reduced deflection aberration. A magnetic deflection yoke is utilized to scan the raster on the screen, and corrective deflective forces are provided on the electron beam to compensate for keystone. In a first embodiment, the corrective forces are provided by a magnetic hexapole field, in second and third embodiments by magnetic quadrapole fields in series with horizontal and vertical deflections respectively, and in a fourth embodiment by providing the combination of a hexapole field and orthogonal quadrapole field in series with horizontal and vertical deflections respectively.

8 Claims, 14 Drawing Figures

FIG. 1
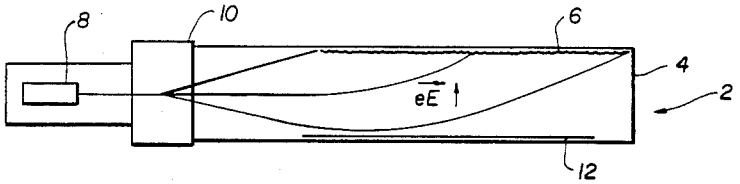
FIG. 2
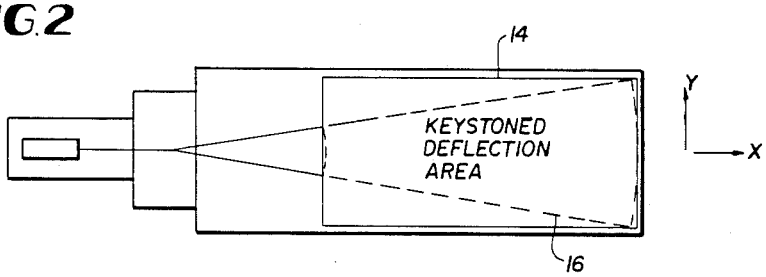
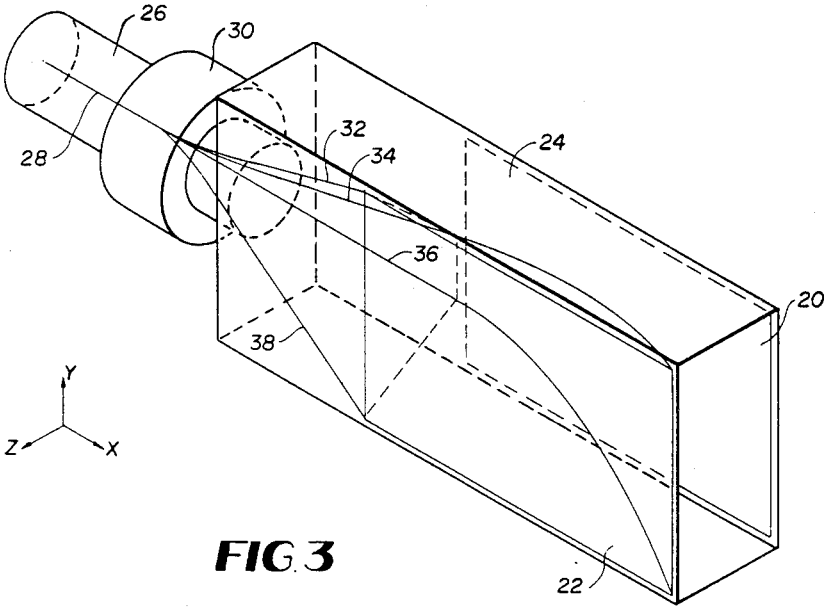
FIG. 3

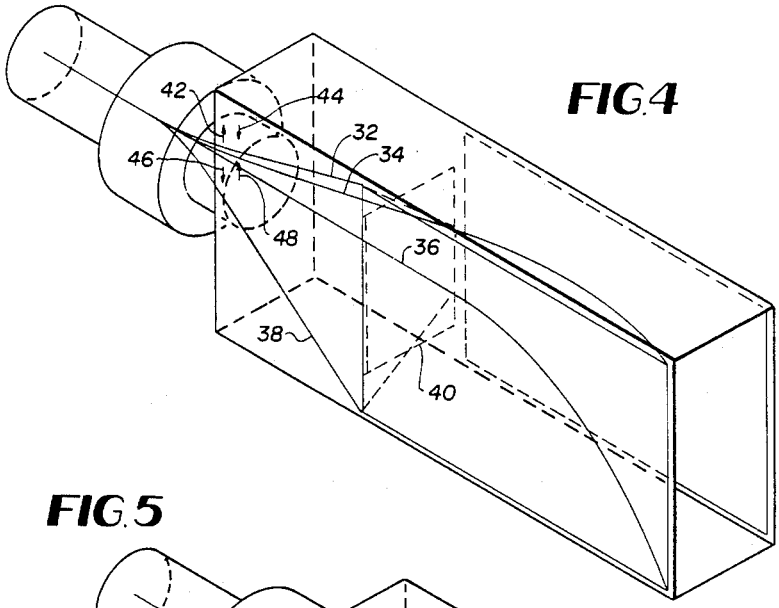
FIG. 4
FIG. 5
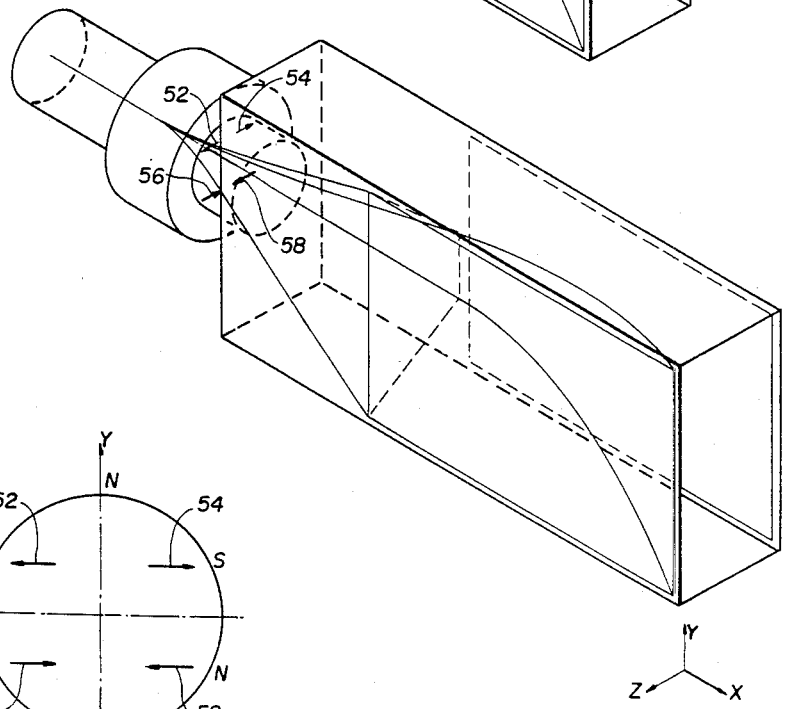
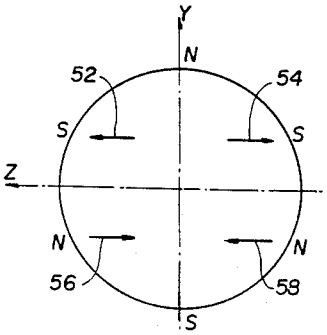
FIG. 6

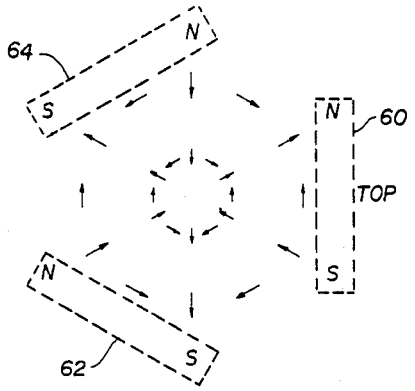
FIG. 7
FIG. 8
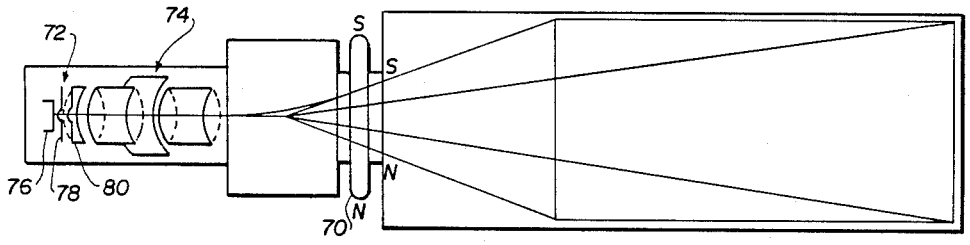
FIG. 9
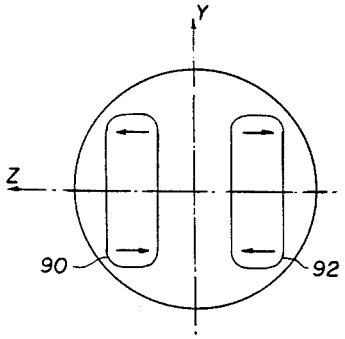
FIG. 10
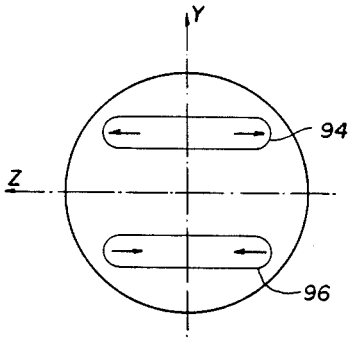

FIG.11
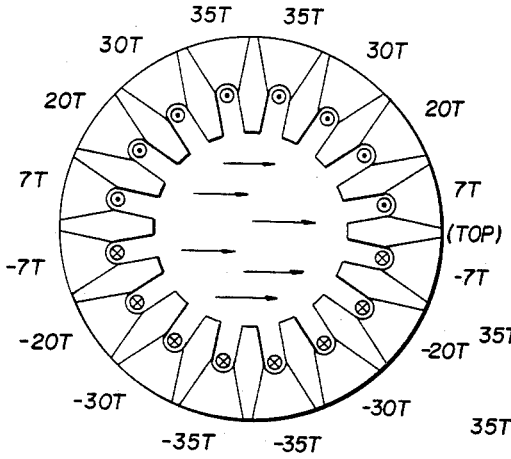
FIG.12
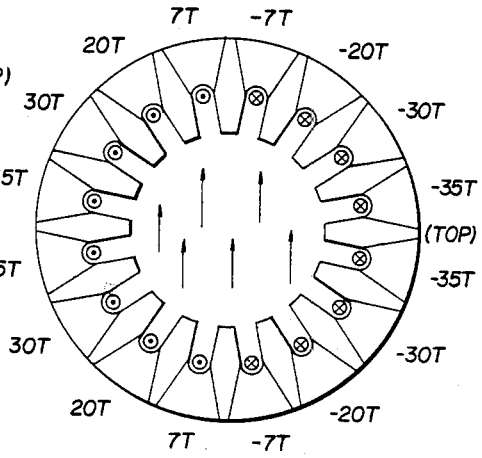
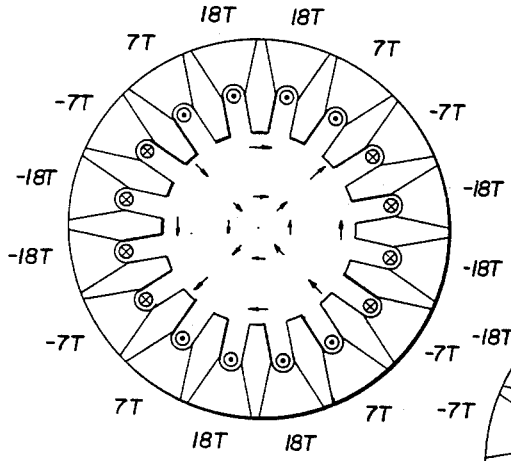
FIG.13
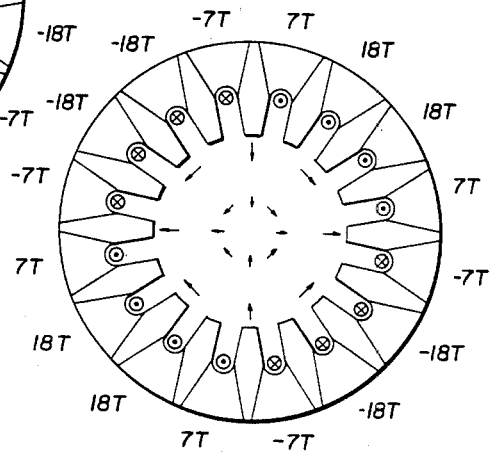
FIG.14

FLAT CATHODE RAY TUBE WITH KEYSTONE COMPENSATION

FIELD OF THE INVENTION

The present invention is directed to improvements in flat cathode ray tubes, and more particularly to apparatus for reducing or eliminating keystone distortion in such tubes.

BACKGROUND OF THE INVENTION

In recent years, small, box-like, relatively flat cathode ray tubes in which the electron beam is generated parallel to the direction of the screen have become known. For instance, such tubes may be used in miniature or pocket televisions recently marketed.

Such a tube is disclosed in Sinclair U.S. Pat. No. 4,205,252 which is incorporated herein by reference. After being generated parallel to the screen, the electron beam is deflected electrostatically, and curved into the screen by a repeller electrode which is maintained at a negative potential in relation to the screen. The effect of the bending of the electron beam is that a raster having a keystone shape instead of the desired rectangular shape is scanned on the screen.

A prior art technique of compensating for the keystone distortion is to excite the deflection means with a complex electrical signal. However, such signals are relatively difficult and expensive to generate.

BRIEF SUMMARY OF THE INVENTION

It is therefore an object of the present invention to provide a flat cathode ray tube wherein keystone distortion is compensated for in a relatively straightforward and inexpensive manner.

It is a further object of the invention to provide a flat cathode ray tube having relatively high resolution.

It is still a further object of the invention to provide a flat cathode ray tube having reduced deflection aberration.

The above objects are accomplished by introducing corrective deflective forces to the tube which act on the electron beam in proximity to the main beam deflection means which is used to scan the raster. In a first embodiment of the invention the forces are introduced by a magnetic hexapole, and in second and third embodiments by a magnetic quadrapole. In a fourth embodiment, a magnetic hexapole and a pair of orthogonally disposed magnetic quadrapoles are used.

Raster deflection is provided by a magnetic deflection yoke. The use of magnetic instead of the usual electrostatic deflection results in relatively high resolution and reduced deflection aberration.

BRIEF DESCRIPTION OF THE DRAWINGS

The invention will be better understood by referring to the accompanying drawings, in which:

FIG. 1 is a side view of a flat cathode ray tube.

FIG. 2 is a top view of a flat cathode ray tube, showing the keystone distortion.

FIG. 3 is an isometric of the tube depicted in FIGS. 1 and 2, and shows a correct rectangular raster.

FIG. 4 is an isometric of the tube which additionally shows the forces necessary to exert on the electron beam to compensate for keystone distortion.

FIG. 5 is an isometric of the tube showing the magnetic field necessary to produce the forces shown in FIG. 4.

FIG. 6 is a diagram of the magnetic field shown in FIG. 5.

FIG. 7 is a diagram of a hexapole field, being produced by bar magnets.

FIG. 8 is an embodiment of the tube of the invention utilizing hexapole compensation.

FIG. 9 is a diagram of the magnetic field shown in FIG. 5, and is useful in understanding the quadrapole field in series with horizontal deflection embodiment of the invention.

FIG. 10 is a diagram of the magnetic field shown in FIG. 5, and is useful in understanding the quadrapole field in series with vertical deflection embodiment of the invention.

FIG. 11 shows a dipole magnetic deflection yoke having a magnetic field in the horizontal direction.

FIG. 12 shows a dipole magnetic deflection yoke having a magnetic field in the vertical direction.

FIG. 13 shows a quadrapole winding.

FIG. 14 shows a quadrapole winding having a magnetic field which is everywhere orthogonal to the field shown in FIG. 13.

DETAILED DESCRIPTION OF PREFERRED EMBODIMENTS

Referring to FIGS. 1 and 2, side and top views respectively of cathode ray tube 2 are shown. The tube includes a relatively thin rectangular envelope 4, which for example may be made of glass, and which has a phosphor deposited on surface 6 to form the screen of the tube.

The electron beam is emitted and focused by electron gun and lens, 8, and after being deflected by magnetic deflection yoke 10 is curved into the screen by repeller electrode 12, which is held at a negative potential in relation to the anode at the screen. The raster is scanned in the y direction by deflection at the yoke in the y direction, and is scanned in the x direction by deflection at the yoke in the z direction (perpendicular to the plane of the drawing) which deflection translates into x deflection after curvature of the beam by the repeller electrode.

Referring to FIG. 2, rectangle 14 represents the effective screen area over which it is desired to scan the raster. However, because of the tube geometry and the bending of the electron beam, the raster actually scanned is the keystone shaped area 16.

In accordance with the invention, the keystone distortion is compensated for by providing a compensating magnetic field. However, before proceeding with a description of the invention, it is instructive to consider the isometric drawing of FIG. 3 to better appreciate both the problem and the solution provided by the present invention.

Referring to this figure, rectangular envelope 20 has screen 22 along one side and repeller electrode 24 disposed opposite thereto. A cylindrical neck section 26 feeds electron beam 28 through deflection yoke 30 and into the envelope, where the beam is bent or curved into the screen. The beams as deflected with four different slopes (beams 32, 34, 36, and 38) corresponding to the end points of a rectangular raster on the screen in the xy plane are depicted.

As mentioned above, the tube if not compensated will scan a keystone shape rather than the desired rectangular raster shown in FIG. 3. In order to attain the rectangular raster in the xy plane, the tube of FIG. 3 must have compensating keystone distortion in the yz plane.

Referring to FIG. 4, the corners of dotted rectangle 40 correspond to points which beams 32, 34, 36, and 38 forming the end points of the raster would traverse in the case where keystone distortion is present on the screen. In order to correct the beams so that they define a rectangular raster on the screen, forces 42, 44, 46, and 48 must be generated to deflect the beam in the appropriate y direction.

FIG. 5 depicts the magnetic field at 52, 54, 56, and 58, which is necessary to produce forces 42, 44, 46, and 48, of FIG. 4.

The magnetic field shown in FIG. 5 is re-drawn in FIG. 6, and it is noted that to produce field components $B_z$ oriented in the $+z$ direction in the first and third quadrants and oriented in the $-z$ direction in the second and fourth quadrants:

$$B_z = Hyz$$

where H is a constant with the units of Gauss/cm$^2$. The field must satisfy Maxwell's equations in a source-free region of space, and this can be done by setting, $$B_y = \tfrac{1}{2}H(z^2 - y^2)$$

$$B_x = 0$$

These equations describe a hexapole field, which may be introduced between the yoke and the screen to obtain the desired correcting forces.

The complete hexapole field including $B_y$ is shown in FIG. 7. In that figure the hexapole is created by three bar magnets 60, 62, and 64 disposed about the axis of the cathode ray tube, but any known expedient for producing a hexapole, such as a suitably magnetized ring, or electromagnetic means may also be used.

FIG. 8 illustrates the hexapole 70 being disposed in a cathode ray tube in accordance with an embodiment of the invention. The embodiment depicted in FIG. 8 also has a more complete showing of the gun 72 and lens 74. The gun is comprised of cathode 76 and first and second grids 78 and 80 respectively, while the lens is of the Einzel type, and is comprised of three concentric cylindrical elements. All of the above-described electrodes are conventional and form no part of the present invention.

The change in the slope of the electron beam projected onto the yx plane, $\Delta y_s$ introduced by the hexapole is:

$$\Delta y_s = 1/\rho \int Hyzdx$$

where $\rho$ is the magnetic rigidity of the electrons in Gauss-cm.

If the hexapole is thin, then $$y = BzL/\rho L_{Hy}$$

and $$z = -B_yL/\rho L_{Hy}$$

So, $$\Delta y_x = -HB_yB_zL^2L_{Hy}{}^2L_H/\rho^3$$

where L is the length of the yoke, $L_H$ is the length of the hexapole, and $L_{Hy}$ is the length between the yoke and hexapole centers, all measured in the x direction.

By choosing a suitable value of H the change in the slope of the electron beam projected onto the yx plane effected by the hexapole eliminates keystone distortion in the y direction on the screen. While the y component of the hexapole field will cause some non-linearity in the x or z direction, this can be corrected by known electronic expedients. For example, a non-linear scan with a starting point which varies as the square of the amount of vertical deflection can be used for the horizontal direction.

In accordance with a further embodiment of the invention, the $B_z$ field depicted in FIG. 6 can be provided by a quadrapole winding which is electrically in series with the horizontal deflection winding. In accordance with a still further embodiment, a quadrapole winding in series with the vertical deflection winding is provided.

To illustrate these embodiments, referring to FIG. 9, it is noted that:

$$B_z = Q_{Hy}$$

where $Q_H$ is the magnetic moment in Gauss/cm and is arranged to be positive when the beam is deflected in the $+z$ direction ($B_z$ field lines 90) and is arranged to be negative when the beam is deflected in the $-z$ direction ($B_z$ field lines 92).

The field must satisfy Maxwell's equations in a source-free region of space, and this can be done by setting, $$B_y = Q_Hz$$

$$B_x = 0$$

which is a quadrapole field.

Similarly, referring to FIG. 10, it is noted that:

$$B_z = Q_vz$$

where $Q_v$ is the magnetic moment in Gauss/cm and is arranged to be positive when the beam is deflected in the $+y$ direction ($B_z$ field lines 94) and is arranged to be negative when the beam is deflected in the $-y$ direction ($B_z$ field lines 96).

For Maxwell's equations to be satisfied, $$B_y = -Q_vy$$

$$B_x = 0$$

which is a quadrapole field.

The magnetic deflection yoke includes orthogonally disposed main windings for deflecting the electron beam in the y and z directions. These are conventional dipole windings shown in FIGS. 11 and 12 for providing spatially constant fields in the z and y directions respectively.

The horizontal deflection is produced by a field in the y direction. The deflection angle in the horizontal produced by the main dipole deflection is given by $-\int B_ydx/\rho$. Assuming that $B_y$ is a constant inside the yoke, the deflection of the yoke is then just $-B_yL/\rho$ where L is the length of the yoke. Inside the yoke the value of z, the distance the electron beam has been deflected from the axis in the horizontal direction is $-\frac{1}{2}B_y x^2/\rho$ where x is the distance the beam has travelled into the yoke.

The vertical deflection is produced by a field in the z direction. The deflection angle in the vertical produced by the main dipole deflection is given by $+\int B_z dx/\rho$ Assuming that $B_z$ is a constant inside the yoke, the deflection of the yoke is then just $+B_z L/\rho$ where L is the length of the yoke. Inside the yoke the value of y, the distance the electron beam has been deflected from the axis in the vertical direction is $+\frac{1}{2}B_z x^2/\rho$ where x is the distance the beam has travelled into the yoke.

Because the strength of the quadrapole moment $Q_H$ is proportional to $B_y$, the ratio of $B_y/Q_H$ is a length and will define a point where the quadrapole field cancels the dipole field $B_y$ along the y axis. Let this be $q_H$ so that $Q_H = B_y y/q_H$. The extra deflection introduced by the quadrapole in the y direction is:

$$\Delta y_s = 1/\rho \int B_y y dx/q_H$$

Substituting the given approximation for y inside the yoke, $y = \frac{1}{2}B_z x^2/\rho$ and integrating, $$\Delta y_s = (1/6) B_y B_z L3/q_H \rho 2$$

The value of $q_H$ can be chosen to cancel the vertical component of the keystone distortion. As in the case of the hexapole, there will be a spurious deflection in the z direction. This can be corrected electronically if desired, for example by using a scan with a starting point which varies as the amount of the vertical deflection.

The deflection angle in the vertical is given by $\int B_z dx/\rho$ and as above, assuming that $B_z$ is a constant inside the yoke, the ratio of $B_z/Q_V$ is a length and will define a point where the quadrapole field cancels the dipole field along the z axis. Let this be $q_V$ so that $Q_V = B_z/q_V$. The extra deflection introduced by the quadrapole in the y direction is $$\Delta y_s = 1/\rho \int B_z/z_V z dx$$

The value of z inside the yoke is given by $z = -B_y x^2/2\rho$. Substituting and integrating, $$\Delta y_s = -B_y B_z L^3/6\rho^2 q_V$$

where L is the length of the yoke.

We can now choose $q_V$ so that we have a deflection in the y direction suitable to correct the vertical component of the keystone. As above, the non-linearity in the horizontal direction can be corrected electronically.

The structure of the quadrapole winding used in the embodiment depicted in FIG. 9 which would be in series with the horizontal deflection is shown in FIG. 13 along with the quadrapole field created thereby while the quadrapole winding and field used in the embodiment of FIG. 10, which is in series with the vertical deflection is shown in FIG. 14. In an actual embodiment dipole and quadrapole windings, instead of being separate, could comprise a composite winding.

As described above, the hexapole or one of the two quadrapole embodiments may be used to correct the vertical component of keystone distortion. In a preferred embodiment, the hexapole and both quadrapoles are used simultaneously in order to correct both the vertical and horizontal components of the keystone. This is possible because all three corrections are linearly independent, so that the yz term in the vertical keystone distortion and the $y^2$ and $z^2$ terms in the horizontal keystone distortion can be simultaneously corrected.

There thus has been disclosed a flat cathode ray tube which is compensated for keystone distortion. Typical dimensions of an actual tube in accordance with the invention would be 16" long by 4" high by 2" deep and such a tube would be suited for the display of data as well as pictorial. While, in the preferred embodiment of the invention magnetic hexapoles and quadrapoles are utilized, it would be possible to use electric hexapoles and quadrapoles.

It should be understood that while certain embodiments of the invention have been disclosed, variations falling within the scope of the invention may occur to those skilled in the art, and the invention is limited only by the claims appended hereto, and equivalents.

What is claimed is:

1. A flat cathode ray tube of the type in which the electron beam travels in a path parallel to the screen, having reduced keystone distortion, said tube having a long direction, and comprising:

an envelope having a long direction and a screen disposed therealong;

means for emitting an electron beam and directing it towards said screen;

main deflecting means disposed along the long direction of the tube for deflecting said emitted electron beam in mutually perpendicular directions;

means disposed along the long direction of the tube in the proximity of said main deflecting means for generating a substantially hexapole field for introducing corrective deflective forces to said beam to compensate for said keystone distortion, said means for introducing said forces bounding a cross-sectional area in a plane which is normal to the plane of said screen; and said corrective deflective forces introduced being in opposing directions in successive quadrants of said cross-sectional area.

2. The cathode ray tube of claim 1 wherein said main deflecting means comprises first magnetic deflecting means.

3. The cathode ray tube of claim 2 where said means for introducing corrective deflective forces comprises second magnetic deflecting means.

4. The cathode ray tube of claim 3 wherein said hexapole field is created by permanent magnet means.

5. The cathode ray tube of claim 4 wherein said permanent magnet means is disposed slightly ahead of said first magnetic deflecting means.

6. The cathode ray tube of claim 5 where said hexapole field is created by three bar magnets.

7. The cathode ray tube of claim 5 wherein said hexapole field is created by a ring magnet.

8. In a flat cathode ray tube of the type in which the electron beam travels in a path parallel to the screen, the improvement wherein:

said tube has magnetic deflection means for scanning a raster, and keystone distortion is compensated by providing a substantially hexapole field just ahead of said magnetic deflection means.

* * * * *

UNITED STATES PATENT AND TRADEMARK OFFICE

CERTIFICATE OF CORRECTION

PATENT NO. : 4,490,652

DATED : December 25, 1984

INVENTOR(S) : Beck

It is certified that error appears in the above—identified patent and that said Letters Patent is hereby corrected as shown below:

In the equation at the bottom of column 3, please correct as follows:

$$\Delta y_s = -HB_y B_z L^2 L_{Hy}^2 L_H / \rho^3$$

In column 5, the equation at line 39 should read:

$$\Delta y_s = 1/\rho \int B_z / q_V z dx$$

Signed and Sealed this

*Fourteenth* Day of *May 1985*

[SEAL]

*Attest:*

DONALD J. QUIGG

*Attesting Officer*

*Acting Commissioner of Patents and Trademarks*